US011437723B2

(12) United States Patent
Park et al.

(10) Patent No.: US 11,437,723 B2
(45) Date of Patent: Sep. 6, 2022

(54) ANTENNA APPARATUS

(71) Applicants: Samsung Electro-Mechanics Co., Ltd., Suwon-si (KR); Seoul National University R&DB Foundation, Seoul (KR)

(72) Inventors: Ju Hyoung Park, Suwon-si (KR); Won Cheol Lee, Suwon-si (KR); In Seop Yoon, Incheon (KR); Jung Woo Seo, Seoul (KR); Jung Suek Oh, Seoul (KR)

(73) Assignees: Samsung Electro-Mechanics Co., Ltd., Suwon-si (KR); Seoul National University R&DB Foundation, Seoul (KR)

( * ) Notice: Subject to any disclaimer, the term of this patent is extended or adjusted under 35 U.S.C. 154(b) by 219 days.

(21) Appl. No.: 16/675,889

(22) Filed: Nov. 6, 2019

(65) Prior Publication Data

US 2021/0005968 A1 Jan. 7, 2021

(30) Foreign Application Priority Data

Jul. 3, 2019 (KR) ..... 10-2019-0079870

(51) Int. Cl.

| | |
|---|---|
| ***H01Q 1/38*** | (2006.01) |
| ***H01Q 5/50*** | (2015.01) |
| ***H01Q 1/22*** | (2006.01) |
| ***H01Q 5/10*** | (2015.01) |
| ***H01Q 21/00*** | (2006.01) |
| ***H01Q 1/24*** | (2006.01) |

(Continued)

(52) U.S. Cl.

CPC ..... *H01Q 5/50* (2015.01); *H01Q 1/2208* (2013.01); *H01Q 1/241* (2013.01); *H01Q 1/38* (2013.01); *H01Q 5/10* (2015.01); *H01Q 9/30* (2013.01); *H01Q 13/10* (2013.01); *H01Q 21/0006* (2013.01)

(58) Field of Classification Search

CPC ..... H01Q 5/50; H01Q 1/2208; H01Q 5/10; H01Q 21/0006; H01Q 1/38; H01Q 1/241; H01Q 9/30; H01Q 13/10; H01Q 9/0435; H01Q 21/08; H01Q 1/243; H01Q 1/50; H01Q 5/28; H01Q 15/24

See application file for complete search history.

(56) References Cited

U.S. PATENT DOCUMENTS 4,125,839 A * 11/1978 Kaloi ..... H01Q 9/0435 343/846
5,216,430 A * 6/1993 Rahm ..... H01Q 21/065 343/846

(Continued)

FOREIGN PATENT DOCUMENTS

KR 20-2009-0012093 U 11/2009
KR 10-2019-0010448 A 1/2019

*Primary Examiner* — David E Lotter
(74) *Attorney, Agent, or Firm* — NSIP Law

(57) ABSTRACT

An antenna apparatus may include: a substrate; two feed vias disposed in the substrate; and an antenna pattern disposed on one surface of the substrate, and including a central portion and wing portions protruding from the central portion. A first wing portion and a second wing portion adjacent to the first wing portion, among the wing portions, may be disposed over the two feed vias. The antenna apparatus may be configured to selectively provide a feed signal to either one or both of the two feed vias.

19 Claims, 7 Drawing Sheets

(51) Int. Cl.
*H01Q 9/30* (2006.01)
*H01Q 13/10* (2006.01)

(56) References Cited

U.S. PATENT DOCUMENTS

| | | | | |
|---|---|---|---|---|
| 5,410,323 | A * | 4/1995 | Kuroda | H01Q 9/0428 343/846 |
| 2005/0162318 | A1* | 7/2005 | Higasa | H01Q 9/0407 343/846 |
| 2010/0207830 | A1* | 8/2010 | Parsche | H01Q 9/0435 343/732 |
| 2011/0025571 | A1* | 2/2011 | Adada | H01Q 1/38 343/770 |
| 2019/0027833 | A1 | 1/2019 | Ayala Vazquez et al. | |
| 2021/0013634 | A1* | 1/2021 | Lin | H01Q 25/001 |

* cited by examiner

ANTENNA APPARATUS

CROSS-REFERENCE TO RELATED APPLICATIONS

This application claims the benefit under 35 USC § 119(a) of Korean Patent Application No. 10-2019-0079870 filed on Jul. 3, 2019, in the Korean Intellectual Property Office, the entire disclosure of which is incorporated herein by reference for all purposes.

BACKGROUND

1. Field

The following description relates to an antenna apparatus.

2. Description of Related Art

Mobile communications data traffic is increasing rapidly on a yearly basis. Technological development to support such a leap in data transmissions in real time data traffic in wireless network is underway. For example, applications of the contents of Internet of Things (IoT) based data, live VR/AR in combination with augmented reality (AR), virtual reality (VR), and social networking services (SNS), autonomous navigation, a synch view for real-time image transmission from a user's view point using a subminiature camera, and the like, require communications for supporting the exchange of large amounts of data, for example, 5th generation (5G) communications, millimeter wave (mmWave) communications, or the like.

Thus, millimeter wave (mmWave) communications including 5G communications have been researched, and research into the commercialization/standardization of antenna apparatuses to smoothly implement such millimeter wave (mmWave) communications have been undertaken.

In order to support various frequency bands (e.g., 24 GHZ, 28 GHz, 36 GHz, 38.5 GHz, 60 GHz, and the like) of 5G communications, an antenna apparatus corresponding to the various frequency bands is required. However, in a limited space within a mobile device, there are physical limitations that may preclude mounting a plurality of antenna devices. Therefore, a single antenna device capable of supporting a plurality of frequency bands is desirable.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes: a substrate; two feed vias disposed in the substrate; and an antenna pattern disposed on one surface of the substrate, and including a central portion and wing portions protruding from the central portion. A first wing portion and a second wing portion adjacent to the first wing portion, among the wing portions, are disposed over the two feed vias. The antenna apparatus is configured to selectively provide a feed signal to either one or both of the two feed vias.

The wing portions may be formed symmetrically with respect to the central portion.

The antenna pattern may include slits extending to a center of the antenna pattern.

The wing portions may be formed by the slits.

The first wing portion and the second wing portion may be respectively connected to different feed vias among the two feed vias.

The first wing portion and the second wing portion may be physically insulated from the two feed vias. The first wing portion and the second wing portion may be respectively electrically coupled to different feed vias among the two feed vias to receive the feed signal.

The first wing portion and the second wing portion may be spaced apart by an angle of 90 degrees with respect to the central portion.

The antenna pattern may be configured to generate an RF signal having right hand polarization characteristics in a first frequency band, and generate an RF signal having left hand polarization characteristics in a second frequency band having a higher frequency than the first frequency band, in response to the feed signal being provided to the first wing portion.

The antenna pattern may be configured to generate an RF signal having left hand polarization characteristics in a first frequency band, and generate an RF signal having right hand polarization characteristics in a second frequency band having a higher frequency than the first frequency band, in response to the feed signal being provided to the second wing portion.

In another general aspect, an antenna apparatus includes: a substrate; a first feed via and a second feed via, the first and second feed vias being disposed in the substrate; an antenna pattern disposed on one surface of the substrate, and configured to receive a first feed signal and a second feed signal from the first feed via and the second feed via, respectively. The antenna apparatus is configured to selectively alter phases of the first feed signal and the second feed signal.

The antenna pattern may include a central portion and wing portions protruding from the central portion.

The first feed via may be configured to provide the first feed signal to a first wing portion among the wing portions. The second feed via may be configured to provide the second feed signal to a second wing portion among the wing portions. The second wing portion may be spaced apart from the first wing portion by an angle of −90 degrees.

The antenna pattern may be configured to generate an RF signal having polarization characteristics in a first direction in which the first wing portion is extended in a first frequency band, and generate an RF signal having polarization characteristics in a second direction in which the second wing portion is extended in a second frequency band having a higher frequency than the first frequency band, in response to the first feed signal and the second feed signal. The second feed signal may be delayed from the first feed signal by 90 degrees.

The antenna pattern may be configured to generate an RF signal having polarization characteristics in a second direction in which the second wing portion is extended in a first frequency band, and generate an RF signal having polarization characteristics in a first direction in which the first wing portion is extended in a second frequency band having a higher frequency than the first frequency band, in response to the first feed signal and the second feed signal. The first feed signal may be delayed from the second feed signal by 90 degrees.

The antenna pattern may be configured to generate an RF signal having polarization characteristics in a +45 degree direction from the first direction in which the first wing portion is extended, in a first frequency band and in a second frequency band having a higher frequency than the first frequency band, in response to the first feed signal and the second feed signal. Phases of the first feed signal and the second feed signal may differ by 180 degrees.

The antenna pattern may be configured to generate an RF signal having polarization characteristics in a −45 degree direction from a first direction in which the first wing portion is extended, in a first frequency band and in a second frequency band having a higher frequency than the first frequency band, in response to the first feed signal and the second feed signal. Phases of the first feed signal and the second feed signal may be in-phase.

The antenna pattern may include slits extending to a center of the antenna pattern. The wing portions may be formed by the slits.

The slits may include a first slit extending in a first direction and a second slit extending in a second direction perpendicular to the first direction.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
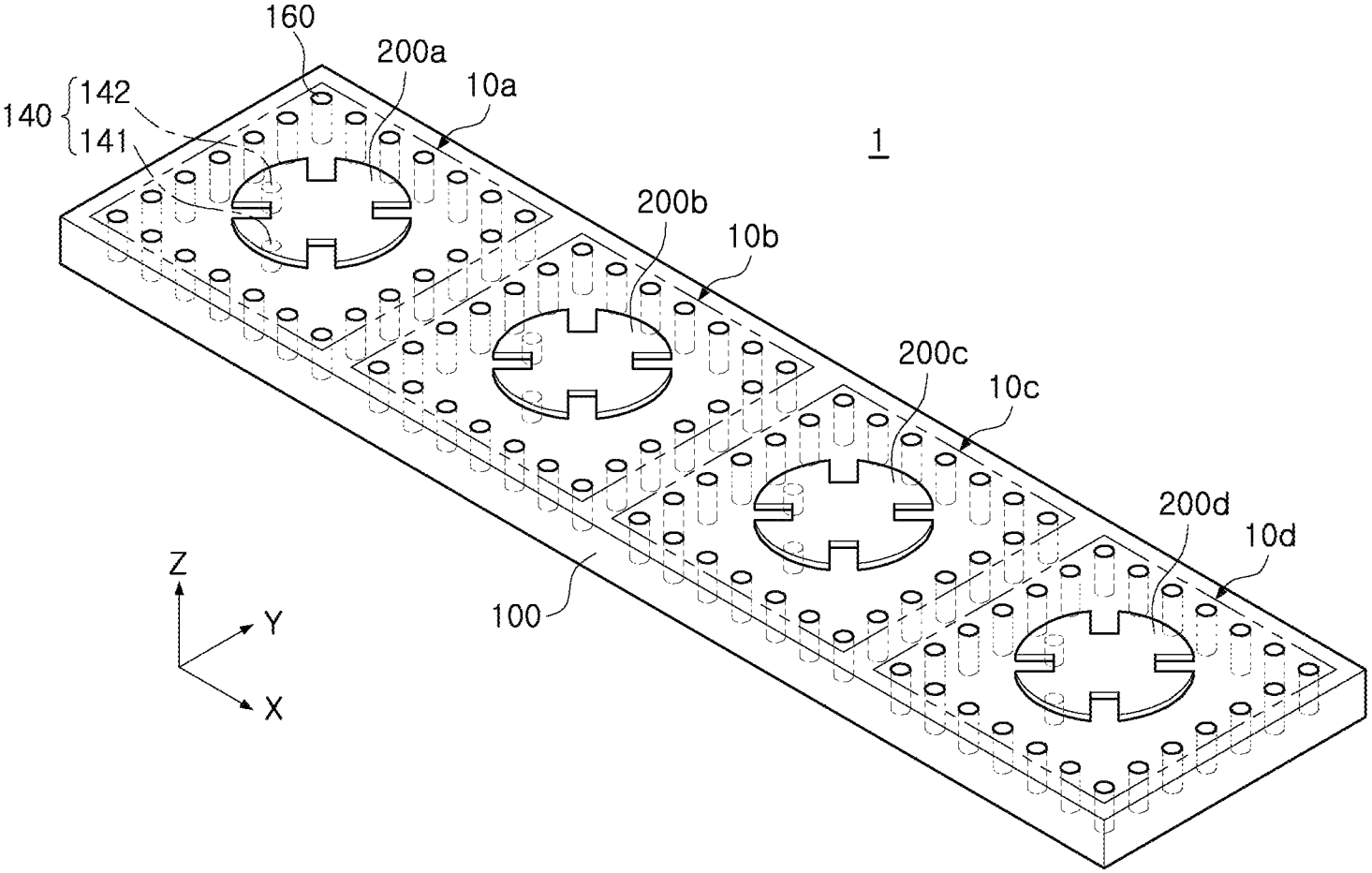
FIG. 1 is a perspective view illustrating an antenna apparatus, according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

According to an aspect of the disclosure herein, an antenna apparatus is capable of supporting various frequency bands.

Figure 2:
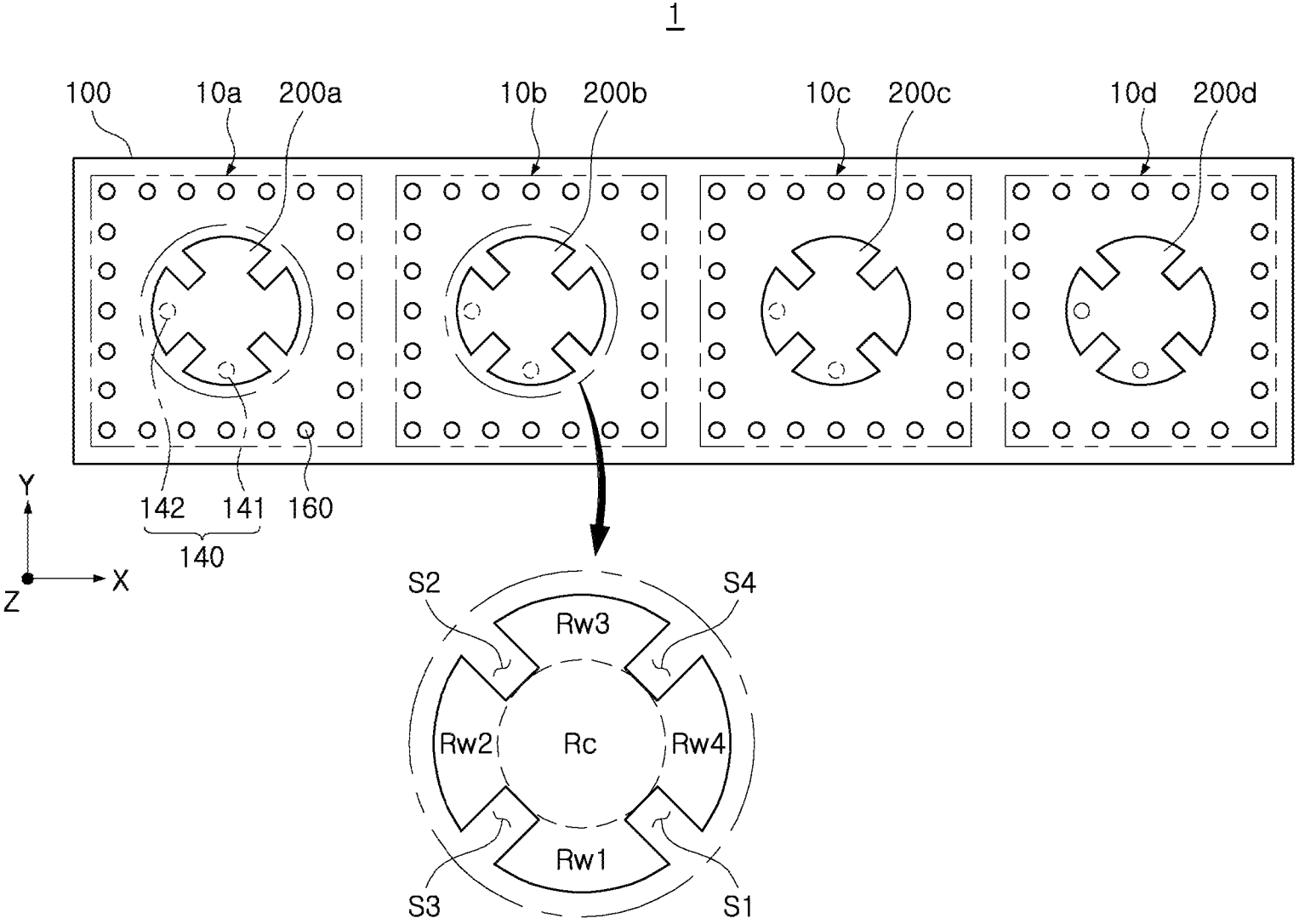
FIG. 2 is a plan view illustrating the antenna apparatus of FIG. 1, according to an embodiment of the present disclosure.
Figure 3:
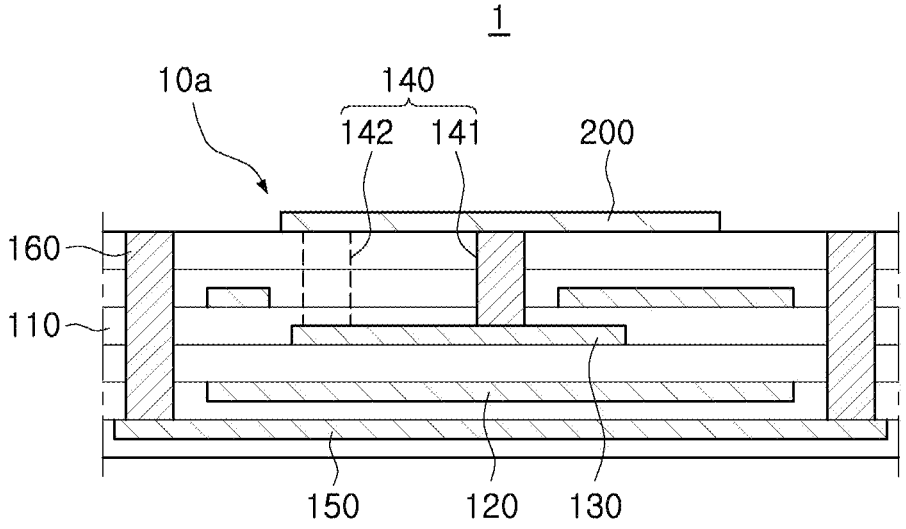
FIG. 3 is a partially cutaway cross-sectional view of the antenna apparatus of FIG. 1, according to an embodiment.

FIG. 1 is a perspective view illustrating an antenna apparatus 1, according to an embodiment. FIG. 2 is a plan view illustrating the antenna apparatus 1. FIG. 3 is a partially cutaway cross-sectional view of the antenna apparatus, and illustrates a first patch antenna 10*a* of the antenna apparatus 1.

Referring to FIGS. 1 and 2, the antenna apparatus 1 may include a substrate 100 and a plurality of antenna patterns 200 (antenna patterns 200*a*, 200*b*, 200*c*, and 200*d*). The antenna apparatus 1 has a length extending in an X-axis direction, a width extending in a Y-axis direction, and a thickness extending in a Z-axis direction.

The substrate 100 may include a printed circuit board (PCB). The substrate 100 may include layers. For example, as shown in FIG. 3, the substrate 100 may be formed by alternately stacking at least one insulating layer 110 and at least one wiring layer 120. For example, the insulating layer 110 may be formed of an insulating material such as prepreg, Ajinomoto build-up film (ABF), FR-4, or bismaleimide triazine (BT). The insulating material may be formed by impregnating a thermosetting resin such as an epoxy resin, a thermoplastic resin such as polyimide, or the aforementioned resins, together, with an inorganic filler such as glass fiber, glass cloth, glass fabric, or the like, to form a core material. In addition, the insulating layer 110 may be formed of a photosensitive insulating resin. According to an embodiment, the substrate 100 may include a flexible substrate, a ceramic substrate, or a glass substrate.

Referring to FIG. 3, the wiring layer 120 may be formed of a conductive material such as copper (Cu), aluminum (Al), silver (Ag), tin (Sn), gold (Au), nickel (Ni), lead (Pb), titanium (Ti), alloys of Cu, Al, Ag, Sn, Au, Ni, Pb, and Ti, or the like.

Still referring to FIG. 3, wiring vias are disposed in the insulating layer 110. For example, the wiring vias may feed vias 140 connected to a feed wiring layer 130 and shielding vias 160 connected to a ground layer 150.

The antenna patterns 200*a*, 200*b*, 200*c*, and 200*d* are disposed on one surface of the substrate 100, as shown in FIGS. 1 to 3. The antenna patterns 200*a*, 200*b*, 200*c*, and 200*d* may be disposed to be spaced apart in an X-axis direction.

Each of the antenna patterns 200*a*, 200*b*, 200*c*, and 200*d* may be formed in a substantially circular shape. However, according to an embodiment, the antenna patterns 200*a*, 200*b*, 200*c*, and 200*d* may be formed in a polygonal shape such as a quadrangle.

Each of the antenna patterns 200*a*, 200*b*, 200*c*, and 200*d* may include slits S1, S2, S3, and S4 extending toward centers the antenna patterns 200*a*, 200*b*, 200*c* and 200*d*, as shown in FIG. 2.

As an example, the slits S1, S2, S3, and S4 may include a first slit S1 and a second slit S2 extending in a first cross direction, and a third slit S3 and a fourth slit S4 extending in a second cross direction. For example, the first cross direction and the second cross direction may be perpendicular to each other.

The first cross direction and the second cross direction are directions extending in an XY plane and crossing each other on the X-axis direction, in which the antenna patterns 200*a*, 200*b*, 200*c*, and 200*d* are spaced apart from each other. The X-axis direction may substantially divide an angle formed by the first cross direction and the second direction into equal parts.

As shown in FIG. 2, the antenna patterns 200*a*, 200*b*, 200*c*, and 200*d* may be divided into a central portion Rc and wing portions Rw1, Rw2, Rw3, and Rw4 by the slits S1, S2, S3, and S4. The wing portions Rw1, Rw2, Rw3, and Rw4 correspond to regions located between the adjacent slits among the slits S1, S2, S3, and S4 in a circumferential direction of each antenna pattern 200*a*, 200*b*, 200*c*, and 200*d*, and the central portion Rc corresponds to a region of an antenna pattern excluding the wing portions Rw1, Rw2, Rw3, and Rw4. The wing portions Rw1, Rw2, Rw3, and Rw4 may be formed to protrude from the central portion Rc. The wing portions Rw1, Rw2, Rw3, and Rw4 may be symmetrically formed about the central portion Rc.

A feed signal may be provided to two adjacent wing portions among the wing portions Rw1, Rw2, Rw3, and Rw4. For example, a feed signal may be provided to the first wing portion Rw1 and the second wing portion Rw2, which are disposed adjacent to each other. The first wing portion Rw1 is a wing portion extending in a Y-axis direction, and the second wing portion Rw2 is a wing portion extending in an X-axis direction.

A separate patch antenna may be configured by the substrate 100 and each of the antenna patterns 200*a*, 200*b*, 200*c*, and 200*d* disposed on the substrate 100.

For example, as shown in FIGS. 1 to 3, a first patch antenna 10*a* is formed by a first portion of the substrate 100 and the first antenna pattern 200*a*, a second patch antenna 10*b* is formed by a second portion of the substrate 100 and the second antenna pattern 200*b*, a third patch antenna 10*c* is formed by a third portion of the substrate 100 and the third antenna pattern 200*c*, and a fourth patch antenna 10*d* is formed by a fourth portion of the substrate 100 and the fourth antenna pattern 200*d*.

Shielding vias 160 are disposed to surround each of the antenna patterns 200*a*, 200*b*, 200*c*, and 200*d*. For example, the shielding vias 160 may be provided in edge regions of the first patch antenna 10*a*, the second patch antenna 10*b*, the third patch antenna 10*c*, and the fourth patch antenna 10*d*. When viewed in a thickness direction of the substrate 100, the shielding vias 160 may surround each of the antenna patterns 200*a*, 200*b*, 200*c*, and 200*d* in an XY plane in a rectangular shape. However, according to an embodiment, the shielding vias 160 may surround each of the antenna patterns 200*a*, 200*b*, 200*c*, and 200*d* in an XY plane in various shapes such as a circle, and the like. In addition, according to an embodiment, the shielding vias 160 may be interconnected to surround each of the antenna patterns 200*a*, 200*b*, 200*c*, and 200*d* in plate form.

As shown in FIG. 3, the shielding via 160 may penetrate the substrate 100 in the thickness direction and may be connected to a ground layer 150 disposed on the other surface of the substrate 100. The ground layer 150 electromagnetically acts as a reflector to the antenna patterns 200*a*, 200*b*, 200*c*, and 200*d*. Therefore, the ground layer 150 may concentrate an RF signal transmitted from the antenna patterns 200*a*, 200*b*, 200*c*, 200*d* in a Z-axis direction corresponding to an aimed direction.

The ground layer 150 may provide a reference potential, for example, a ground potential, to the shielding via 160. By the shielding via 160 being connected to the ground layer 150, interference of the RF signal transmitted and received in the antenna pattern in each patch antenna may be reduced.

The RF signals described herein may be used in various communications protocols such as Wi-Fi (IEEE 802.11 family or the like), WiMAX (IEEE 802.16 family or the like), IEEE 802.20, Long Term Evolution (LTE), Ev-DO, HSPA+, HSDPA+, HSUPA+, EDGE, GSM, GPS, GPRS, CDMA, TDMA, DECT, Bluetooth, 3G, 4G, 5G and various wireless and wired protocols designated thereafter, but the disclosure is not limited to these examples.

Each of the antenna patterns 200*a*, 200*b*, 200*c*, and 200*d* may receive a feed signal from feed vias 140. The feed vias 140 include a first feed via 141 and a second feed via 142.

The first feed via 141 and the second feed via 142 may be connected to the feed wiring via 130 to provide a feed signal to a respective antenna pattern among the antenna patterns 200*a*, 200*b*, 200*c*, and 200*d*. In FIG. 3, although the first feed via 141 and the second feed via 142 are illustrated as being connected to one feed wiring layer 130, according to an embodiment, the first feed via 141 and the second feed via 142 may be connected to different feed wiring layers 130 to provide different feed signals to the respective antenna pattern among the antenna patterns 200*a*, 200*b*, 200*c*, and 200*d*.

The first feed via 141 and the second feed via 142 extend to the one surface of the substrate 100 on which the antenna patterns 200*a*, 200*b*, 200*c*, and 200*d* are disposed. The first feed via 141 and the second feed via 142 may be connected to the respective antenna pattern among the antenna patterns 200*a*, 200*b*, 200*c*, and 200*d* to provide a feed signal directly to the respective antenna pattern among the antenna patterns 200*a*, 200*b*, 200*c*, and 200*d*.

According to an embodiment, the first feed via 141 and the second feed via 142 extend to a position spaced apart from one surface of the substrate 100 by a predetermined distance, and are physically insulated from the respective antenna pattern among the antenna patterns 200*a*, 200*b*, 200*c*, and 200*d*. The first feed via 141 and the second feed via 142 extend to a sufficiently close position with respect to the respective antenna pattern among the antenna patterns 200*a*, 200*b*, 200*c*, and 200*d*, and may be electrically coupled to the respective antenna pattern to provide a feed signal indirectly.

The first feed via 141 and the second feed via 142 may be disposed to have an angle difference of 90 degrees, with respect to each other, from a center of the respective antenna pattern among the antenna patterns 200*a*, 200*b*, 200*c*, and 200*d*. The first feed via 141 is disposed in the Y-axis direction from the center of the antenna pattern, and the second feed via 142 is disposed in the X-axis direction from the center of the antenna pattern. The second feed via 142 may be disposed to have an angle difference of −90 degrees from the first feed via 141 based on the center of the respective antenna pattern among the plurality of antenna patterns 200*a*, 200*b*, 200*c*, and 200*d*.

For example, the first feed via 141 extends toward a first wing portion Rw1, among the wing portions Rw1, Rw2, Rw3, and Rw4, in the substrate 100. In addition, the second feed via 142 extends toward a second wing portion Rw2, among the wing portions Rw1, Rw2, Rw3, and Rw4, having an angle difference of −90 degrees from the first wing portion Rw1 in the substrate 100. That is, the first wing portion Rw1 may be disposed over the first feed via 141, and the second wing portion Rw2 may be disposed over the second feed via 142. Therefore, the first feed via 141 may provide a first feed signal to the first wing portion Rw1, and the second feed via 142 may provide a second feed signal to the second wing portion Rw2.

Recently, a multi-input/multi-output (MIMO) system has been applied to mobile devices equipped with antenna apparatuses. MIMO is a technology that can increase a bandwidth in proportion to the number of antennas. If N antennas are used, N times frequency efficiency may be obtained compared to a single antenna. However, according to a trend of slimming and miniaturization of mobile devices, there is a limitation in a space in which the antenna is mounted, and in the condition in which the antennas used in the existing system exists, there are physical limitations in additionally implementing a plurality of antennas. Therefore, one antenna needs to support a plurality of frequency bands.

Figure 4:
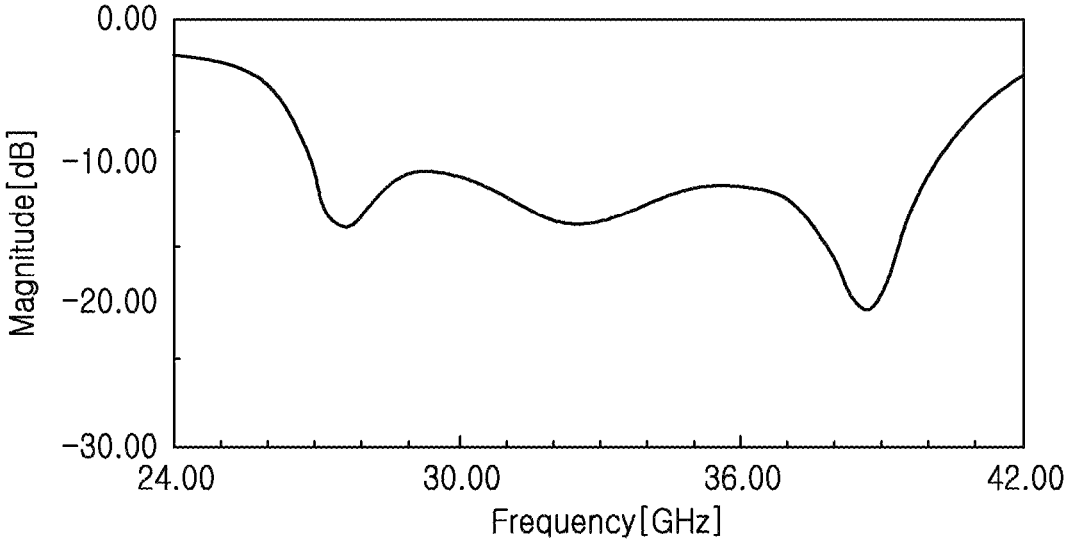
FIG. 4 is an S-parameter graph illustrating a return loss of an antenna apparatus, according to an embodiment.

FIG. 4 is an S-parameter graph illustrating a return loss of an antenna apparatus, according to an embodiment.

Typically, in the S-parameter graph, a region in which a value of the S-parameter is less than −10 dB may be used as a pass band of the antenna apparatus.

Referring to FIG. 4, the S-parameter graph has a value of the S-parameter less than −10 dB in a frequency band of about 26.85 GHZ to about 40.19 GHz.

Therefore, an antenna apparatus according to an embodiment disclosed herein may transmit and receive an RF signal from a 28 GHz band corresponding to the first frequency band to a 38.5 GHz band corresponding to the second frequency band. The antenna apparatus may support a plurality of frequency bands in a broad band from the 28 GHz band to the 38.5 GHz band.

FIGS. 5A, 5B, 6A, 6B, 6C, and 6D are views provided to illustrate a feed method, according to various embodiments. Hereinafter, referring to FIGS. 5A, 5B, 6A, 6B, 6C, and 6D, the feed method will be described.

The antenna apparatus 1, according to an embodiment, may selectively provide a feed signal to either one or both of the first feed via 141 and the second feed via 142. For example, the antenna apparatus 1 may provide a feed signal to the first feed via 141, the antenna apparatus 1 may provide a feed signal to the second feed via 142, and the antenna apparatus 1 may provide a feed signal to the first feed via 141 and the second feed via 142.

When a feed signal is provided to one feed via among the first feed via 141 and the second feed via 142, an RF signal having circular polarization characteristics is generated in an antenna pattern under an influence of the other feed via that is not provided with the feed signal.

Figure 5A:
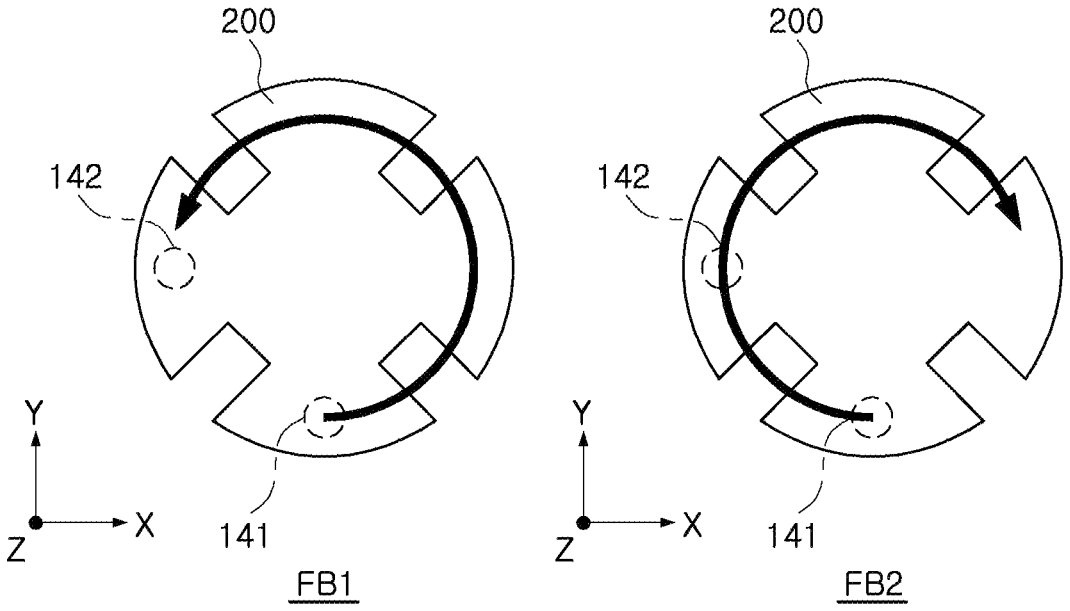
FIGS. 5A, 5B, 6A, 6B, 6C, and 6D are views illustrating a feed method, according to embodiments.

Referring to FIG. 5A, when a feed signal is provided to the first feed via 141, an RF signal having right hand circular polarization (RHCP) characteristics is generated in a first frequency band FB1, and an RF signal having left hand circular polarization (LHCP) characteristics is generated in a second frequency band FB2.

Figure 5B:
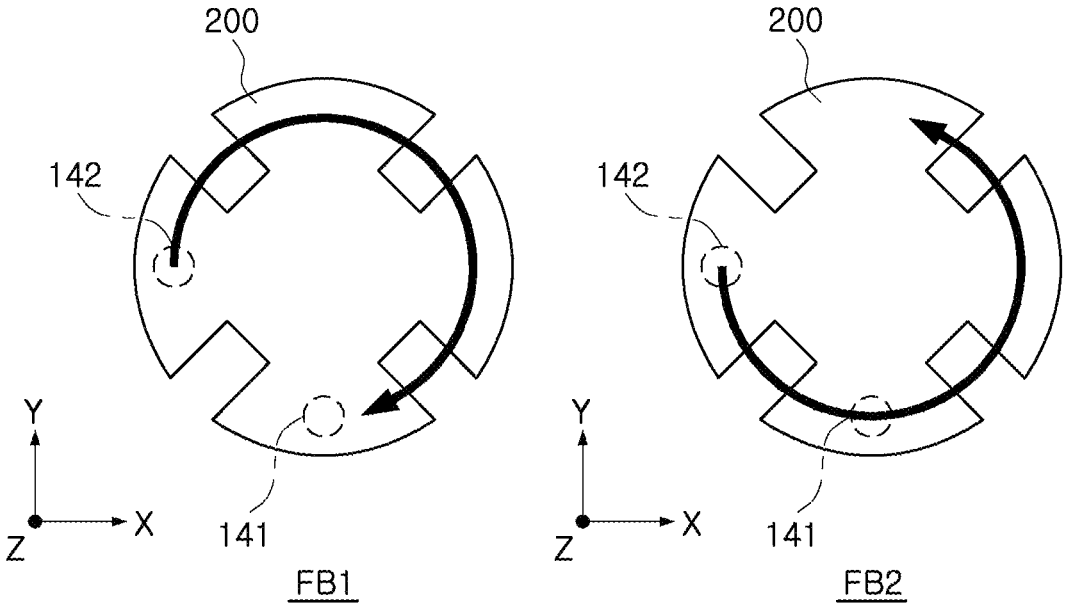

In addition, referring to FIG. 5B, when a feed signal is provided to the second feed via 142, an RF signal having left hand circular polarization (LHCP) characteristics is generated in the first frequency band FB1, and an RF signal having right circular polarization (RHCP) characteristics is generated in the second frequency band FB2.

When a feed signal is provided to both the first feed via 141 and the second feed via 142, the antenna apparatus 1 may selectively alter a phase of the feed signal provided to the first feed via 141 and the second feed via 142.

The antenna apparatus 1 may selectively alter the phases of the feed signals provided to the first feed via 141 and the second feed via 142, and an RF signal having various polarization characteristics may be generated.

Figure 6A:
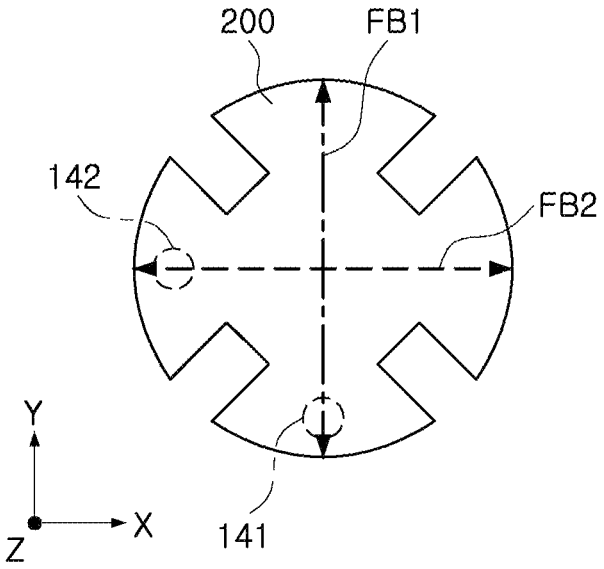

Referring to FIG. 6A, when the phase of the feed signal provided to the second feed via 142 is 90 degrees later than that of the feed signal provided to the first feed via 141, an RF signal having polarization characteristics in the Y-axis direction is generated in the first frequency band FB1, and an RF signal having polarization characteristics in the X-axis direction is generated in the second frequency band FB2.

Figure 6B:
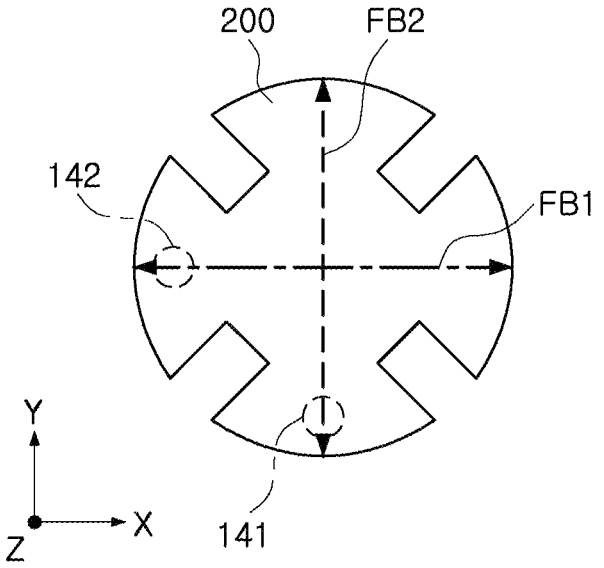

Referring to FIG. 6B, when the phase of the feed signal provided to the second feed via 142 is 90 degrees ahead of the phase of the feed signal provided to the first feed via 141, an RF signal having polarization characteristics in the X-axis direction is generated in the first frequency band FB1, and an RF signal having polarization characteristics in the Y-axis direction is generated in the second frequency band FB2.

Figure 6C:
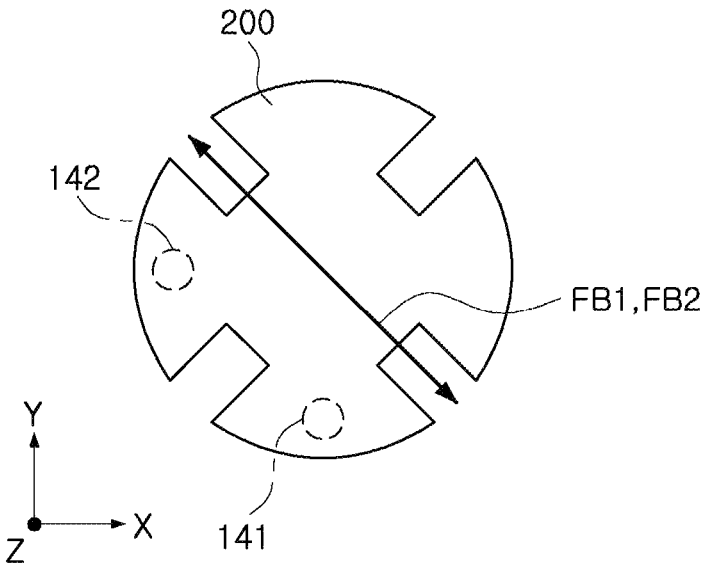

Referring to FIG. 6C, when the phase of the feed signal provided to the first feed via 141 and the phase of the feed signal provided to the second feed via 142 differ by 180 degrees, an RF signal having polarization characteristics in a +45 degree direction from the Y-axis direction is generated in the first frequency band FB1 and the second frequency band FB2.

Figure 6D:
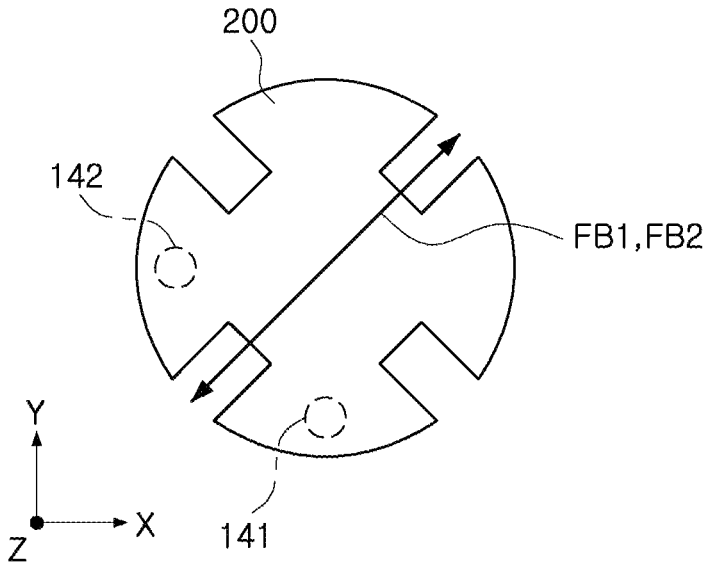

Referring to FIG. 6D, when a feed signal provided to the first feed via 141 and a feed signal provided to the second feed via 142 are in-phase, an RF signal having polarization characteristics in a −45 degrees direction from the Y-axis direction is generated.

An antenna apparatus according to an embodiment disclosed herein may selectively provide a feed signal to either one or both of two feed vias, or may selectively alter a phase of two feed signals provided the two feed vias, thereby generating an RF signal having various polarization characteristics. Therefore, the disclosed antenna apparatus may be employed in mobile devices that require various polarization characteristics.

Figure 7:
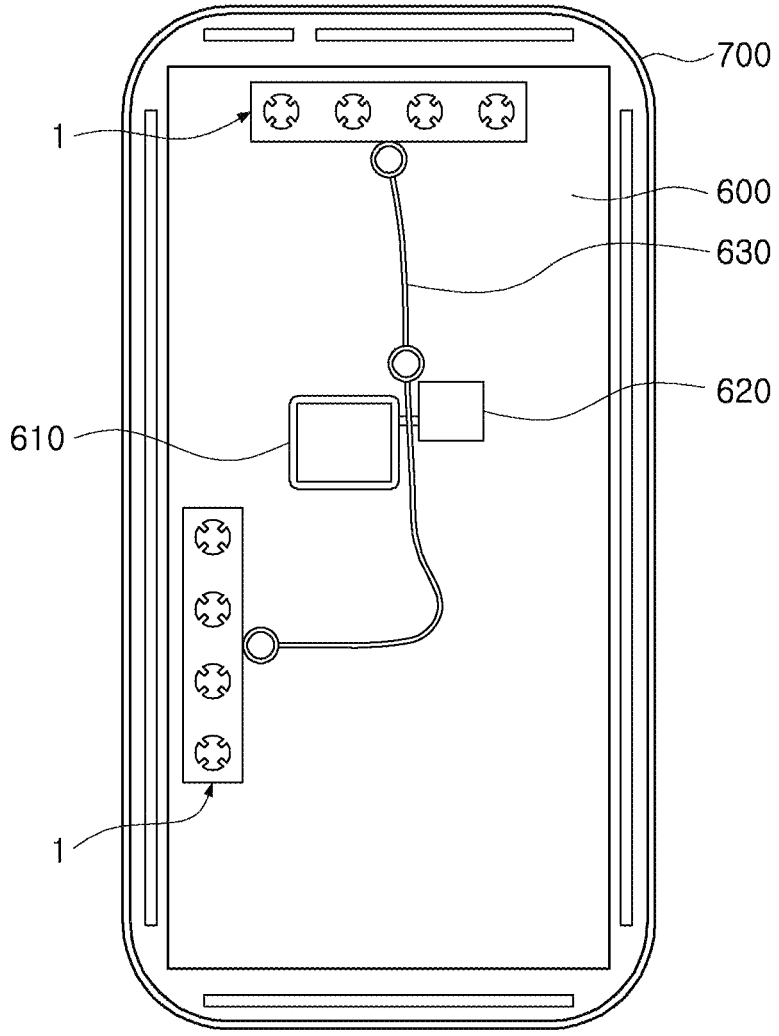
FIG. 7 is a plan view illustrating an arrangement of an antenna apparatus in an electronic device, according to an embodiment.

FIG. 7 is a plan view illustrating an arrangement of the antenna apparatus 1 in an electronic device 700, according to an embodiment.

Referring to FIG. 7, an antenna module including the antenna apparatus 1 may be disposed adjacent to a side surface edge of the electronic device 700 on a set substrate 600 of the electronic device 700.

The electronic device 700 may be a smartphone, a personal digital assistant, a digital video camera, a digital still camera, a network system, a computer, a monitor, a tablet PC, a laptop computer, a netbook, a television set, a video game, a smartwatch, an automotive component, or the like, but is not limited to these examples.

A communications module 610 and a baseband circuit 620 may be disposed on the set substrate 600. The antenna apparatus 1 may be electrically connected to the communications module 610 and/or the baseband circuit 620 via a coaxial cable 630.

The communications module 610 may include at least a portion of a memory chip such as a volatile memory (for example, a dynamic random access memory (DRAM)), a nonvolatile memory (for example, a read only memory (ROM)), a flash memory, or the like; an application processor chip such as a central processor (for example, a central processing unit (CPU)), a graphics processor (for example, a graphics processing unit (GPU)), a digital signal processor, a cryptographic processor, a microprocessor, a microcontroller, or the like; and a logic chip such as an analog-to-digital (ADC) converter, an application-specific integrated circuit (ASIC), or the like, to perform digital signal processing.

The baseband circuit 620 may perform analog-to-digital conversion, amplification for an analog signal, filtering, and frequency conversion to generate a base signal. A base signal input/output from the baseband circuit 620 may be transmitted to the antenna module via a cable.

For example, the base signal may be transmitted to an IC through the electrical connection structure, the core via, and the wiring. The IC may convert the base signal into an RF signal in a millimeter wave (mmWave) band.

As set forth above, an antenna apparatus according to an embodiment disclosed herein may support various frequency bands. In addition, the antenna apparatus may generate an RF signal having various polarization characteristics.

The communications module 610 in FIG. 7 that performs the operations described in this application is implemented by hardware components configured to perform the operations described in this application that are performed by the hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer. Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

Instructions or software to control computing hardware, for example, one or more processors or computers, to implement the hardware components and perform the methods as described above may be written as computer programs, code segments, instructions or any combination thereof, for individually or collectively instructing or configuring the one or more processors or computers to operate as a machine or special-purpose computer to perform the operations that are performed by the hardware components and the methods as described above. In one example, the instructions or software include machine code that is directly executed by the one or more processors or computers, such as machine code produced by a compiler. In another example, the instructions or software includes higher-level code that is executed by the one or more processors or computer using an interpreter. The instructions or software may be written using any programming language based on the block diagrams and the flow charts illustrated in the drawings and the corresponding descriptions in the specification, which disclose algorithms for performing the operations that are performed by the hardware components and the methods as described above.

The instructions or software to control computing hardware, for example, one or more processors or computers, to implement the hardware components and perform the methods as described above, and any associated data, data files, and data structures, may be recorded, stored, or fixed in or on one or more non-transitory computer-readable storage media. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, and any other device that is configured to store the instructions or software and any associated data, data files, and data structures in a non-transitory manner and provide the instructions or software and any associated data, data files, and data structures to one or more processors or computers so that the one or more processors or computers can execute the instructions. In one example, the instructions or software and any associated data, data files, and data structures are distributed over network-coupled computer systems so that the instructions and software and any associated data, data files, and data structures are stored, accessed, and executed in a distributed fashion by the one or more processors or computers.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a substrate;

two feed vias disposed in the substrate; and an antenna pattern disposed on one surface of the substrate, and comprising a central portion and wing portions protruding from the central portion, wherein a first wing portion and a second wing portion adjacent to the first wing portion, among the wing portions, are disposed over the two feed vias, and wherein the antenna apparatus is configured to selectively provide a feed signal to either one or both of the two feed vias.

2. The antenna apparatus of claim 1, wherein the wing portions are formed symmetrically with respect to the central portion.

3. The antenna apparatus of claim 1, wherein the antenna pattern comprises slits extending to a center of the antenna pattern.

4. The antenna apparatus of claim 3, wherein the wing portions are formed by the slits.

5. The antenna apparatus of claim 1, wherein the first wing portion and the second wing portion are respectively connected to different feed vias among the two feed vias.

6. The antenna apparatus of claim 5, wherein the first wing portion and the second wing portion are physically insulated from the two feed vias, and the first wing portion and the second wing portion are respectively electrically coupled to different feed vias among the two feed vias to receive the feed signal.

7. The antenna apparatus of claim 1, wherein the first wing portion and the second wing portion are spaced apart by an angle of 90 degrees with respect to the central portion.

8. The antenna apparatus of claim 7, wherein the antenna pattern is configured to generate an RF signal having right hand polarization characteristics in a first frequency band, and generate an RF signal having left hand polarization characteristics in a second frequency band having a higher frequency than the first frequency band, in response to the feed signal being provided to the first wing portion.

9. The antenna apparatus of claim 7, wherein the antenna pattern is configured to generate an RF signal having left hand polarization characteristics in a first frequency band, and generate an RF signal having right hand polarization characteristics in a second frequency band having a higher frequency than the first frequency band, in response to the feed signal being provided to the second wing portion.

10. An antenna apparatus, comprising:

a substrate;

a first feed via and a second feed via, the first and second feed vias being disposed in the substrate;

an antenna pattern disposed on one surface of the substrate, comprising a central portion and wing portions protruding from the central portion, and configured to receive a first feed signal and a second feed signal from the first feed via and the second feed via, respectively, wherein a first wing portion and a second wing portion adjacent to the first wing portion, among the wing portions, are disposed over the two feed vias, and wherein the antenna apparatus is configured to selectively alter phases of the first feed signal and the second feed signal.

11. The antenna apparatus of claim 10, wherein the first feed via is configured to provide the first feed signal to the first wing portion among the wing portions, wherein the second feed via is configured to provide the second feed signal to the second wing portion among the wing portions, and wherein the second wing portion is spaced apart from the first wing portion by an angle of −90 degrees.

12. The antenna apparatus of claim 11, wherein the antenna pattern is configured to generate an RF signal having polarization characteristics in a first direction in which the first wing portion is extended in a first frequency band, and generate an RF signal having polarization characteristics in a second direction in which the second wing portion is extended in a second frequency band having a higher frequency than the first frequency band, in response to the first feed signal and the second feed signal, and wherein the second feed signal is delayed from the first feed signal by 90 degrees.

13. The antenna apparatus of claim 11, wherein the antenna pattern is configured to generate an RF signal having polarization characteristics in a second direction in which the second wing portion is extended in a first frequency band, and generate an RF signal having polarization characteristics in a first direction in which the first wing portion is extended in a second frequency band having a higher frequency than the first frequency band, in response to the first feed signal and the second feed signal, and wherein the first feed signal is delayed from the second feed signal by 90 degrees.

14. The antenna apparatus of claim 11, wherein the antenna pattern is configured to generate an RF signal having polarization characteristics in a +45 degree direction from a first direction in which the first wing portion is extended, in a first frequency band and in a second frequency band having a higher frequency than the first frequency band, in response to the first feed signal and the second feed signal, and wherein phases of the first feed signal and the second feed signal differ by 180 degrees.

15. The antenna apparatus of claim 11, wherein the antenna pattern is configured to generate an RF signal having polarization characteristics in a −45 degree direction from a first direction in which the first wing portion is extended, in a first frequency band and in a second frequency band having a higher frequency than the first frequency band, in response to the first feed signal and the second feed signal, and wherein phases of the first feed signal and the second feed signal are in-phase.

16. The antenna apparatus of claim 10, wherein the antenna pattern comprises slits extending to a center of the antenna pattern, and the wing portions are formed by the slits.

17. The antenna apparatus of claim 16, wherein the slits comprise a first slit extending in a first direction and a second slit extending in a second direction perpendicular to the first direction.

18. The antenna apparatus of claim 1, further comprising a plurality of shielding vias disposed in the substrate to surround the antenna pattern.

19. The antenna apparatus of claim 10, further comprising a plurality of shielding vias disposed in the substrate to surround the antenna pattern.

* * * * *